US012521835B2

(12) United States Patent
Gedlick et al.

(10) Patent No.: US 12,521,835 B2
(45) Date of Patent: Jan. 13, 2026

(54) ROCK TUMBLING METHOD AND APPARATUS

(71) Applicant: Idea Vault Holdings Inc., Ashland, OR (US)

(72) Inventors: Joshua J Gedlick, Ashland, OR (US); Alexander Darin Smith, Ashland, OR (US); Jennifer Ann Hanson, Ashland, OR (US); Michael Edwin Munter, Ashland, OR (US)

(73) Assignee: IDEA VAULT HOLDINGS INC., Ashland, OR (US)

( * ) Notice: Subject to any disclaimer, the term of this patent is extended or adjusted under 35 U.S.C. 154(b) by 1008 days.

(21) Appl. No.: 16/591,575

(22) Filed: Oct. 2, 2019

(65) Prior Publication Data

US 2020/0391340 A1 Dec. 17, 2020

Related U.S. Application Data

(63) Continuation-in-part of application No. 16/566,839, filed on Sep. 10, 2019.

(60) Provisional application No. 62/704,066, filed on Jun. 15, 2019.

(51) Int. Cl.
*B24B 31/02* (2006.01)
*B24B 31/14* (2006.01)

(52) U.S. Cl.
CPC ..... *B24B 31/02* (2013.01); *B24B 31/14* (2013.01)

(58) Field of Classification Search
CPC ..... B24B 31/00; B24B 31/02; B24B 31/03; B24B 31/033; B24B 31/037; B24B 31/06; B24B 31/10; B24B 31/14
USPC ..... 451/32, 34, 35, 326, 328, 330
See application file for complete search history.

(56) References Cited

U.S. PATENT DOCUMENTS

| | | | | |
|---|---|---|---|---|
| 295,867 A | | 3/1884 | Griffen | |
| 2,939,455 A | | 6/1960 | Arnold | |
| 3,094,818 A | * | 6/1963 | Price | B24B 31/0218 451/329 |
| 3,327,431 A | * | 6/1967 | Smith | B24B 31/06 366/110 |
| 3,453,782 A | * | 7/1969 | Karl | B24B 31/14 451/330 |

(Continued)

FOREIGN PATENT DOCUMENTS

| | | | |
|---|---|---|---|
| CN | 301948246 | S | 6/2011 |
| CN | 301982100 | S | 7/2012 |

(Continued)

*Primary Examiner* — Monica S Carter
*Assistant Examiner* — Jonathan R Zaworski
(74) *Attorney, Agent, or Firm* — Womble Bond Dickinson (US) LLP

(57) ABSTRACT

After three or four abrasive rock tumbling steps with successively finer and finer adhesive, the rocks are tumbled with pieces of an elastomer, for example plastic foam. The plastic foam may be polyurethane foam. The result is a higher polish than could be achieved by prior abrasive and finishing approaches. A polishing compound may be embedded in the polyurethane foam. Advantages of doing this include that the user gets multiple polishings out of the material base, there is less breakage of the rocks during tumbling process, and the tumbling mix will not "sludge up" if the user were to let the barrel sit after tumbling.

20 Claims, 3 Drawing Sheets

(56) References Cited

U.S. PATENT DOCUMENTS

| | | | | | |
|---|---|---|---|---|---|
| 3,504,124 | A * | 3/1970 | Kittredge | B24B 31/14 | 451/33 |
| 3,594,956 | A * | 7/1971 | Conover | B24B 31/05 | 451/328 |
| 3,613,317 | A * | 10/1971 | Kittredge | C25D 5/52 | 451/330 |
| 3,971,167 | A * | 7/1976 | van Moppes | B24B 31/02 | 451/328 |
| 4,188,129 | A * | 2/1980 | Thompson | B24B 31/06 | 451/328 |
| 4,630,401 | A * | 12/1986 | McNeil | B24B 31/06 | 451/37 |
| 5,140,783 | A * | 8/1992 | Hoffman | B08B 7/02 | 451/330 |
| 5,401,206 | A * | 3/1995 | Majors | B24B 31/06 | 451/104 |
| 5,507,685 | A * | 4/1996 | Hoffman | B24B 31/02 | 451/330 |
| 6,254,466 | B1 | 7/2001 | Muccicciaro | | |
| 9,156,709 | B2 | 10/2015 | Shallcross | | |
| D757,136 | S | 5/2016 | Yu | | |
| 9,421,664 | B1 * | 8/2016 | Yu | B24B 31/02 | |
| D868,125 | S | 11/2019 | Shu | | |
| D914,906 | S | 3/2021 | Klein | | |
| D917,063 | S | 4/2021 | Ong | | |
| D923,199 | S | 6/2021 | Luther | | |
| D940,763 | S | 1/2022 | Zhao | | |
| D964,593 | S | 9/2022 | Grimmel | | |
| 2020/0017302 | A1 * | 1/2020 | Lindbo | C12C 11/006 | |
| 2020/0391339 | A1 * | 12/2020 | Gedlick | B24B 31/06 | |
| 2020/0391340 | A1 * | 12/2020 | Gedlick | B24B 31/02 | |
| 2021/0260717 | A1 | 8/2021 | Gedlick | | |

FOREIGN PATENT DOCUMENTS

| | | | | |
|---|---|---|---|---|
| CN | 304073644 | S | 3/2017 | |
| CN | 304073646 | S | 3/2017 | |
| CN | 306374463 | S | 3/2021 | |
| CN | 306604369 | S | 6/2021 | |
| CN | 306638442 | S | 6/2021 | |
| CN | 306648318 | S | 6/2021 | |
| CN | 306985282 | S | 12/2021 | |
| CN | 307119758 | S | 2/2022 | |
| CN | 307181808 | S | 3/2022 | |
| DE | 102008014726 | A1 * | 9/2009 | B24B 31/02 |
| GB | 6179994 | | 1/2022 | |
| GB | 6179995 | | 1/2022 | |
| WO | WO-2018060504 | A1 * | 4/2018 | A21B 3/00 |

* cited by examiner

ROCK TUMBLING METHOD AND APPARATUS

BACKGROUND

Rock tumbling is a popular hobby and is also an important commercial activity.

Tumbling of rocks as a lapidary technique for rock polishing usually requires a plastic or rubber-lined barrel loaded with a consignment of rocks, all of similar or the same hardness, some abrasive grit, and a liquid lubricant. Silicon carbide grit is commonly used, and water is a universal lubricant. The barrel is then placed upon slowly rotating rails so that it rotates. The optimal speed of rotation depends on the size of the tumbler barrel and materials involved.

A well-chosen speed for stone polishing causes the rocks within the barrel to slide past each other, with the abrasive grit between them. The result of this depends on the coarseness of the abrasive, and the duration of the tumble.

Typically, a full tumble polish from rough rock to polish takes between 3-5 weeks, and is done in a minimum of 3 steps. Initially, the rocks are smoothed with a coarse grit (such as 60-90 mesh). The idea behind the first step is to take rough rock or stone and grind it (tumble it) down into a form which is indistinguishable (in shape) from the final product. This is followed by washing and then a stage of finer grits (120-220 then 400-600 mesh), before the (optional) use of a pre-polishing compound (1200 grit), and perhaps a washing cycle with detergent to remove any grit on the stones. There may be a final step that is a polishing stage using powdered polish, (such as cerium oxide or tin oxide), water, and often small plastic pellets that are designed to cushion the stones as they tumble (so as not to cause chipping) and carry the polish evenly across the stones.

Plastic beads or pellets, grit media, waxes, ceramic beads, oils, soap, and organic material like walnut shells have all been employed in various tumbling approaches.

The precise tumbling duration is determined by many factors, including the hardness of the rock and the degree of smoothing desired in the coarser steps. Some people will tumble stones with rough grit for two, three or even four weeks to get their desired shapes out of the stones.

There are two main types of rock tumbling: barrel (rotary) tumbling, and vibratory tumbling. Rotary tumbling is more common, simpler, quieter and less expensive than vibratory tumblers. There are two differentiating factors, however, that may lead one to use a vibratory tumbler. First, vibratory tumblers retain the overall shape of the rough rock, whereas rotary tumblers tend to make rocks round. Thus, it is important to use vibratory tumblers to make faceted shapes and tear-drop forms. Second, vibratory tumblers tend to work much faster than rotary tumblers, generally reducing the processing time to half.

In the polishing step, rock polish is added in place of grit as well as the plastic tumbling pellets. After further tumbling, the rocks should now have a shiny look when dry. If this is not the case and the rocks appear to have a film on them, a burnishing step may be necessary. In burnishing, the rocks are tumbled with only the plastic pellets and the addition of an oil-free non-abrasive soap.

Sometimes, stone "preforms" are used. These are shapes cut from the rough rock before tumbling. This gives more control over the final piece, so shapes such as a tear drop can be produced. The technique is still limited to rounded shapes. Preforms may use less time with the coarsest step, or skip it altogether.

During the 1970s, small rock tumblers were a common hobby item, and jewelry decorated with tumbled semi-precious stones was very much in fashion. Likewise, dishes and decorative glass jars filled with tumbled stones (often including common rocks not suitable even for costume jewelry) were frequently used as household ornaments.

It would be desirable if a way could be devised to accomplish higher polish than is commonly accomplished after several processing stages as described above.

SUMMARY OF THE INVENTION

After three or four abrasive rock tumbling steps with successively finer and finer adhesive, the rocks are tumbled with pieces of an elastomer, for example an elastomer foam, more particularly a plastic foam. The plastic foam may be polyurethane foam. The result is a higher polish than could be achieved by prior abrasive and finishing approaches. A polishing compound may be embedded in the polyurethane foam. Advantages of doing this include that the user gets multiple polishings out of the material base, there is less breakage of the rocks during tumbling process, and the tumbling mix will not "sludge up" if the user were to let the barrel sit after tumbling.

DESCRIPTION OF THE DRAWING

The invention is described with the assistance of a drawing in several figures, of which.

DETAILED DESCRIPTION

Figure 1:
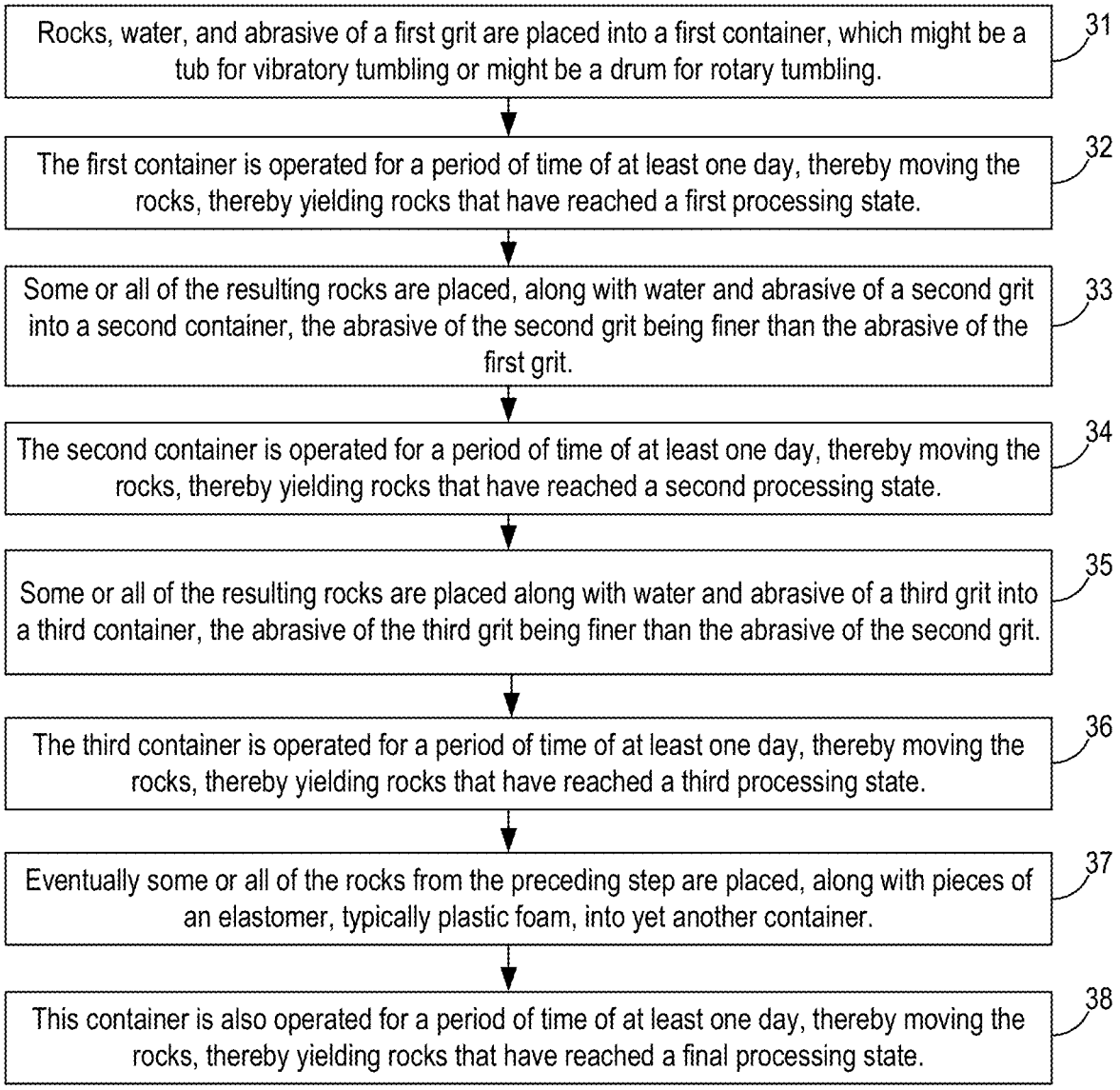
FIG. 1 shows steps of a method.

FIG. 1 shows steps of a method. Rocks, water, and abrasive of a first grit are placed (31) into a first container, which might be a tub for vibratory tumbling or might be a drum for rotary tumbling. The first container is operated (32) for a period of time of at least one day, thereby moving the rocks, thereby yielding rocks that have reached a first processing state. Some or all of the resulting rocks are placed (33), along with water and abrasive of a second grit into a second container, the abrasive of the second grit being finer than the abrasive of the first grit. The second container is operated (34) for a period of time of at least one day, thereby moving the rocks, thereby yielding rocks that have reached a second processing state. Some or all of the resulting rocks are placed (35) along with water and abrasive of a third grit into a third container, the abrasive of the third grit being finer than the abrasive of the second grit. The third container is operated (36) for a period of time of at least one day, thereby moving the rocks, thereby yielding rocks that have reached a third processing state.

There may be a fourth abrasive tumbling step, using an abrasive that is finer than the abrasive employed in the previous tumbling step.

Eventually some or all of the rocks from the preceding step are placed (37), along with pieces of an elastomer, typically plastic foam, into yet another container. This container is also operated (38) for a period of time of at least one day, thereby moving the rocks, thereby yielding rocks that have reached a final processing state. This final processing state yields a higher polish compared with prior approaches.

Later, after the tumbling is done, the plastic foam pieces may be allowed to dry before storage. Allowing the plastic foam pieces to dry before storage minimizes the risk of mold or other degradation of the plastic foam pieces.

In a typical sequence of events, the first container, second container, third container and fourth container are the same container.

The pieces used in the final tumbling step are an elastomer, typically an elastomer foam, and more particularly plastic foam. A desirable type of foam for this purpose is polyurethane foam. The foam pieces desirably have a durometer value in the range of 0 to 80 Shore00 Durometer and more desirably in the range of 0 to 70 Shore00 Durometer. The elastomer pieces may be as small as 0.8 cubic centimeters (0.05 cubic inches) or as large as 8 cubic centimeters (0.5 cubic inches). A typical size is 1.3 cubic centimeters (0.08 cubic inches).

The elastomer is typically plastic foam. Typically the plastic is polyurethane foam. One approach is to embed a polishing compound into the foam, for example into the polyurethane foam. A big advantage of doing this is that the user will get multiple polishings out of the material base, and will incur less breakage of the rocks during tumbling process. In addition, the tumbling mix will not "sludge up" if the user allows the barrel to sit for some time after tumbling.

Those experienced with rock tumbling will appreciate that the plastic pellets used in the prior art have been made of hard plastic and are not made of elastomer material. Such plastic pellets as have been used in the prior art fall well above the Shore00 Durometer value of 80. It is appreciated that plastic foam pieces bring about a different result in the tumbling process than the prior-art hard plastic pellets, in particular a higher polish.

The step of tumbling with pieces of elastomer can be done with or without water in the container.

Figure 2:
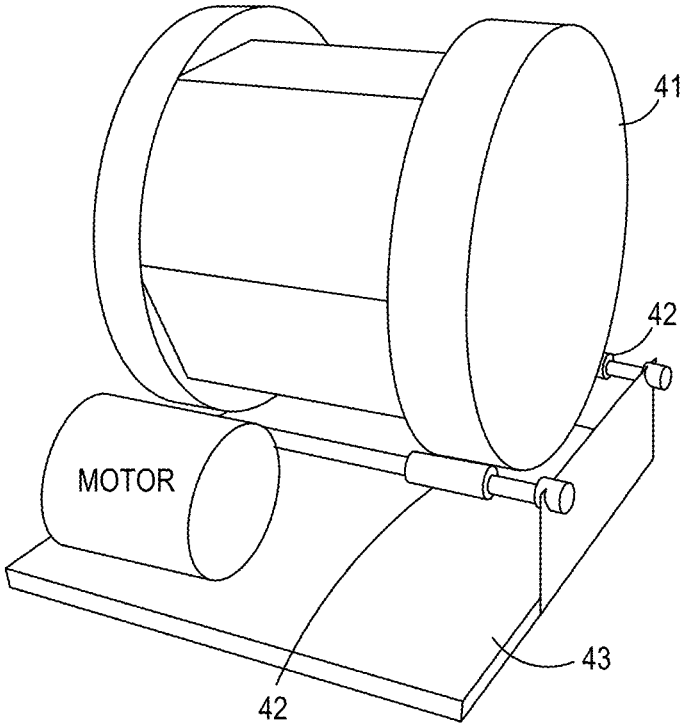
FIG. 2 shows a drum tumbler approach.
Figure 3:
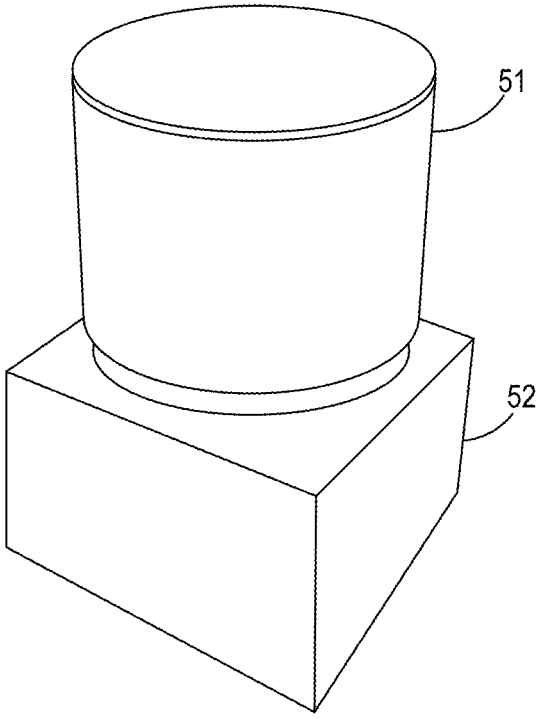
FIG. 3 shows a vibration approach.
Figure 4:
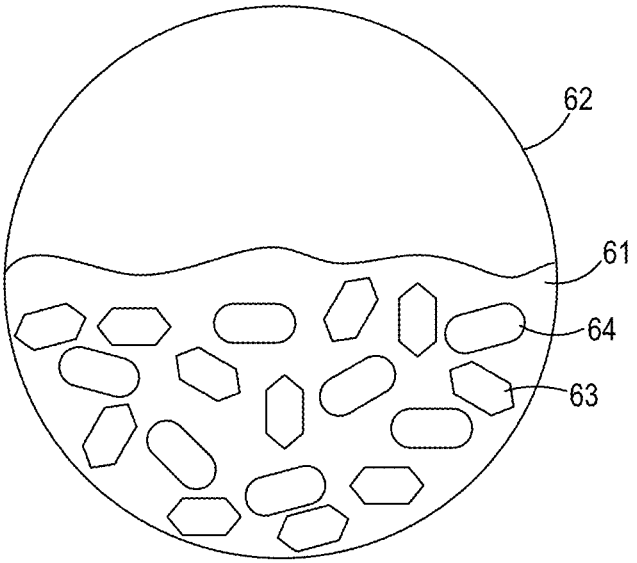
FIG. 4 shows contents of a drum.

The tumbling can be rotary tumbling in a drum, as shown in FIG. 2, or can be vibratory tumbling in a tub, as shown in FIG. 3. FIG. 2 shows the drum 41 which rolls on rollers 42, on a motorized base 42. FIG. 3 shows the tub 51 which is mounted on a base 52. FIG. 4 shows contents of a drum 62, including water 61, stones 63, and pellets 64.

Figure 5:
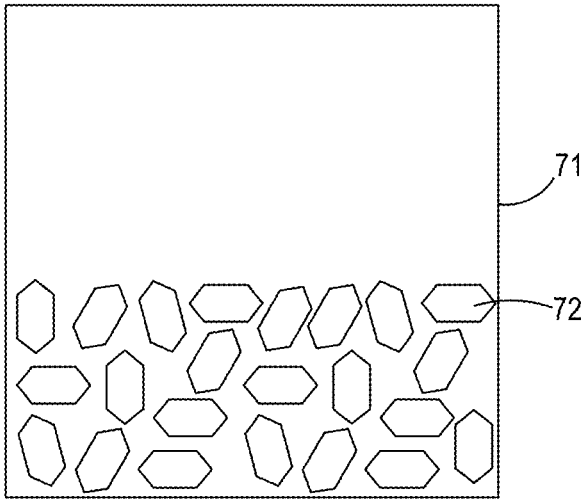
FIG. 5 shows a package with foam.

A large number of such foam pieces may be conveniently transported in a package of a size no larger than 0.2 cubic meters. FIG. 5 shows such a package 71 with foam pellets 72 inside, some of which are omitted for clarity in FIG. 5.

The alert reader will have no difficulty devising myriad obvious improvements and variations, all of which are intended to be encompassed by the claims which follow.

The invention claimed is:

1. A method comprising the steps of:

placing rocks, water, and abrasive of a first grit into a first container;

operating the first container for a period of time of at least one day, thereby moving the rocks, thereby yielding first resulting rocks that have reached a first processing state;

placing some of the first resulting rocks, along with water and abrasive of a second grit into a second container, the abrasive of the second grit being finer than the abrasive of the first grit;

operating the second container for a period of time of at least one day, thereby moving the rocks, thereby yielding second resulting rocks that have reached a second processing state;

placing some of the second resulting rocks along with water and abrasive of a third grit into a third container, the abrasive of the third grit being finer than the abrasive of the second grit;

operating the third container for a period of time of at least one day, thereby moving the rocks, thereby yielding third resulting rocks that have reached a third processing state;

placing some of the third resulting rocks, along with pieces of an elastomer embedded with a polishing compound, into a fourth container;

operating the fourth container for a period of time of at least one day, thereby moving the rocks, thereby yielding final resulting rocks that have reached a final processing state;

wherein the pieces of an elastomer are monolithic pieces of elastomer foam, the pieces of elastomer foam having a size in the range of 0.8 cubic centimeters to 8 cubic centimeters, the pieces of elastomer foam further having a durometer value in the range of 0 to 80 Shore00 Durometer.

2. The method of claim 1 further comprising first and second intermediate steps, the first and second intermediate steps taking place between the step of operating the third container and the step of placing some of the third resulting rocks, along with pieces of elastomer, into the fourth container;

the first intermediate step comprising placing some of the third resulting rocks, along with water and abrasive of a fourth grit, into a fifth container, the abrasive of the fourth grit being finer than the abrasive of the third grit;

the second intermediate step comprising operating the fifth container for a period of time of at least one day, thereby moving the rocks, thereby yielding new third resulting rocks that have reached a further processing state;

and wherein the step of placing some of the third resulting rocks, along with pieces of the elastomer embedded with the polishing compound, into the fourth container comprises placing some of the new third resulting rocks into the fourth container.

3. The method of claim 1 wherein the first container, second container, third container and fourth container are the same container.

4. The method of claim 1 wherein the step of placing some of the third resulting rocks, along with pieces of the elastomer, into the fourth container further comprises placing water into the fourth container.

5. The method of claim 1 wherein each container is a drum, and wherein the operating of the container comprises rotating the drum, and wherein the moving of the rocks comprises tumbling the rocks.

6. The method of claim 1 wherein each container is a tub, and wherein the operating of the container comprises vibrating the tub, and wherein the moving of the rocks comprises vibrating the rocks.

7. The method of claim 1 further comprising a drying step, performed after the step of operating the fourth container with the pieces of an elastomer, of allowing the pieces of an elastomer to dry before storage.

8. The method of claim 1 wherein the elastomer is plastic, and wherein the pieces of an elastomer are pieces of plastic foam.

9. The method of claim 8 wherein the plastic foam is a polyurethane foam.

10. The method of claim 2 wherein the elastomer foam is plastic foam, and wherein the pieces of an elastomer foam are pieces of plastic foam.

11. The method of claim 10 wherein the plastic foam comprises polyurethane foam.

12. The method of claim 3 wherein the elastomer foam is polyurethane foam, and wherein the pieces of elastomer foam are pieces of polyurethane foam.

13. The method of claim 4 wherein the elastomer foam comprises a plastic foam.

14. The method of claim 4 wherein the pieces of elastomer foam comprises pieces of polyurethane foam.

15. The method of claim 5 wherein the pieces of elastomer foam comprises plastic foam.

16. The method of claim 5 wherein the elastomer foam comprises a polyurethane foam.

17. The method of claim 6 wherein the pieces of elastomer foam are a plastic foam.

18. The method of claim 17 wherein the plastic foam comprises a polyurethane foam.

19. The method of claim 7 wherein the pieces of elastomer foam are plastic foam.

20. The method of claim 19 wherein the plastic foam comprises polyurethane foam.

* * * * *